US009439451B2

(12) United States Patent
Volgger

(10) Patent No.: US 9,439,451 B2
(45) Date of Patent: Sep. 13, 2016

(54) PAPER FILLED WITH TOBACCO PARTICLES

(71) Applicant: DELFORTGROUP AG, Traun (AT)

(72) Inventor: Dietmar Volgger, Schwaz (AT)

(73) Assignee: delfortgroup AG, Traun (AT)

( * ) Notice: Subject to any disclaimer, the term of this patent is extended or adjusted under 35 U.S.C. 154(b) by 146 days.

(21) Appl. No.: 14/334,869

(22) Filed: Jul. 18, 2014

(65) Prior Publication Data

US 2014/0326262 A1 Nov. 6, 2014

Related U.S. Application Data

(63) Continuation of application No. PCT/EP2013/000094, filed on Jan. 14, 2013.

(30) Foreign Application Priority Data

Jan. 18, 2012 (EP) ..... 12151612

(51) Int. Cl.
*A24B 15/16* (2006.01)
*A24B 3/14* (2006.01)
*A24B 15/12* (2006.01)

(52) U.S. Cl.
CPC ..... *A24B 15/16* (2013.01); *A24B 3/14* (2013.01); *A24B 15/12* (2013.01)

(58) Field of Classification Search
USPC ..... 131/347, 352, 364; 162/141, 148, 149; 428/221, 323, 332, 357, 402
See application file for complete search history.

(56) References Cited

U.S. PATENT DOCUMENTS

| | | | | |
|---|---|---|---|---|
| 4,542,755 A | 9/1985 | Selke | 131/370 |
| 4,646,764 A * | 3/1987 | Young | A24B 3/14 131/324 |
| 5,322,076 A | 6/1994 | Brinkley | 131/374 |
| 2005/0263161 A1 | 12/2005 | Mua | 131/297 |
| 2006/0021626 A1 | 2/2006 | Mua | 131/365 |
| 2008/0216854 A1 | 9/2008 | Nicholls | 131/372 |

FOREIGN PATENT DOCUMENTS

WO WO 03/082030 10/2003 ..... A24B 15/14

OTHER PUBLICATIONS

Introduction to Stock Prep Refining, Aikawa Fiber Technologies, 8 pages, no date, [online], retrieved from the Internet, [retrieved Jan. 2, 2015], <URL: http://www.aikawagroup.com/downloads/Training_Manual.pdf>.*

Particle Size Conversion, Sigma-Aldrich, no date, [online], retrieved from the Internet, [retrieved Dec. 14, 2010], <URL: http://ww.sigmaaldrich.com/chemistry/stockroom-reagents/learning-center/technical-library/particle-size-conversion.html>.*

(Continued)

*Primary Examiner* — Dennis Cordray
(74) *Attorney, Agent, or Firm* — Sunstein Kann Murphy & Timbers LLP

(57) ABSTRACT

What is presented is a paper for mixing into the smokeable material of a smoking article, particularly into the tobacco rod of a cigarette, wherein the paper contains a share of fibers, which comprises pulp fibers and tobacco particles.

23 Claims, 2 Drawing Sheets

| | Parameters | | Fibers | | | Other paper components in % of the paper mass | | | | |
|---|---|---|---|---|---|---|---|---|---|---|
| | Diffusivity | Basis Weight | Long Fibers | Short Fibers | Tobacco Particles | Chalk | Starch | Tobacco Solution | Aromatic Substances | Potassium Citrate |
| No | cm/s | g/m² | % | % | % | % | % | % | % | % |
| 2 | 0.712 | 65.6 | 95 | 0 | 5 | 40 | 0.25 | 3.3 | 0.0 | 2.2 |
| 3 | 0.652 | 63.0 | 95 | 0 | 5 | 40 | 0.25 | 3.3 | 0.0 | 0.0 |
| 4 | 0.459 | 63.2 | 80 | 10 | 10 | 40 | 0.25 | 3.13 | 0.0 | 1.9 |
| 5 | 0.451 | 63.2 | 80 | 10 | 10 | 40 | 0.25 | 3.13 | 2.0 | 1.9 |
| 6 | 0.348 | 60.6 | 80 | 10 | 10 | 40 | 0.25 | 3.13 | 0.0 | 0.0 |
| 7 | 0.017 | 32.6 | 80 | 10 | 10 | 0 | 0.25 | 3.13 | 0.0 | 2.0 |
| 8 | 1.732 | 60.5 | 0 | 80 | 20 | 40 | 0.25 | 3.13 | 0.0 | 2.0 |

Data of the paper samples

(56) References Cited

OTHER PUBLICATIONS

International Searching Authority—EPO, International Search Report and Written Opinion, PCT/EP2013/000094; dated Apr. 26, 2013. 12 pages.

International Searching Authority—EPO, English translation of International Preliminary Report on Patentability (Ref AG), PCT/EP2013/000094; dated Jul. 31, 2014. 8 pages.

* cited by examiner

| | Parameters | | Fibers | | | Other paper components in % of the paper mass | | | | |
|---|---|---|---|---|---|---|---|---|---|---|
| | Diffusivity | Basis Weight | Long Fibers | Short Fibers | Tobacco Particles | Chalk | Starch | Tobacco Solution | Aromatic Substances | Potassium Citrate |
| No | cm/s | g/m² | % | % | % | % | % | % | % | % |
| 2 | 0.712 | 68.6 | 95 | 0 | 5 | 40 | 0.25 | 3.3 | 0.0 | 2.2 |
| 3 | 0.652 | 63.0 | 95 | 0 | 5 | 40 | 0.25 | 3.3 | 0.0 | 0.0 |
| 4 | 0.459 | 63.2 | 80 | 10 | 10 | 40 | 0.25 | 3.13 | 0.0 | 1.9 |
| 5 | 0.431 | 63.2 | 80 | 10 | 10 | 40 | 0.25 | 3.13 | 2.0 | 1.9 |
| 6 | 0.348 | 60.6 | 80 | 10 | 10 | 40 | 0.25 | 3.13 | 0.0 | 0.0 |
| 7 | 0.017 | 32.5 | 80 | 10 | 10 | 0 | 0.25 | 3.13 | 0.0 | 2.0 |
| 8 | 1.732 | 60.5 | 0 | 80 | 20 | 40 | 0.25 | 3.13 | 0.0 | 3.0 |

Data of the paper samples

Fig. 1

| | Tar | | Nicotine | | Carbon Monoxide | | Puff Number | |
|---|---|---|---|---|---|---|---|---|
| | | Reduction | | Reduction | | Reduction | | Reduction |
| No. | mg/cig | % | mg/cig | % | mg/cig | % | | % |
| 1 | 17.23 | | 1.22 | | 15.77 | | 7.45 | |
| 2 | 5.67 | -67% | 0.37 | -70% | 10.80 | -32% | 6.68 | -10% |
| 3 | 6.40 | -63% | 0.36 | -70% | 11.27 | -29% | 7.07 | -5% |
| 4 | 7.75 | -55% | 0.50 | -59% | 11.73 | -26% | 6.70 | -10% |
| 5 | 7.25 | -58% | 0.45 | -63% | 11.27 | -29% | 6.58 | -12% |
| 6 | 7.18 | -58% | 0.45 | -63% | 12.57 | -20% | 7.11 | -5% |
| 7 | 1.08 | -36% | 0.60 | -51% | 14.94 | -5% | 8.07 | +8% |
| 8 | 6.23 | -64% | 0.49 | -60% | 10.15 | -35% | 6.80 | -9% |

Data of the test cigarettes

Fig. 2

PAPER FILLED WITH TOBACCO PARTICLES

This application is a continuation of Patent Cooperation Treat application PCT/EP2013/000094, filed Jan. 14, 2013, which in turn claims priority to European Patent Application 12 151 612.4, filed Jan. 18, 2012, both of which are incorporated herein by reference in their entireties.

TECHNICAL FIELD

The present invention relates to the field of smoking articles. Particularly, it relates to means for reducing harmful substances in the smoke of such a smoking article, such as tar, nicotine and carbon monoxide.

BACKGROUND ART

The development of cigarettes with low smoke yields is an important trend in the cigarette industry in order to reduce the harmful effects of tobacco smoke. This is mainly driven by legal requirements, as in many countries upper limits for the components of the smoke, such as tar, nicotine or carbon monoxide, are in force. For example, in the European Union it is not permissible to produce or sell cigarettes which provide more than 10 mg tar, 1 mg nicotine or 10 mg carbon monoxide in a standardized test. Similar laws exist also in other countries.

A typical cigarette consists of a tobacco rod, which is wrapped by a cigarette paper and is mostly of a cylindrical shape. Additionally, there is a filter at one end, which mostly consists of cellulose acetate and is wrapped with a filter wrapping paper. Additionally to pure cellulose acetate filters, there is the possibility to employ segmented filters. These comprise one or more segments, in which different substances, such as activated carbon or paper filters, are located. The filter and the tobacco rod, wrapped with the cigarette paper are connected to each other by a tipping paper. Furthermore, it is known to perforate the tipping paper in order to dilute the smoke, which flows through the filter.

The smoke yields of a cigarette can be determined by means of a procedure according to ISO 4387. Here, a cigarette is lit at the first puff and after that a puff is taken each minute with a puff duration of 2 seconds and a volume of 35 $cm^3$ with a sinus-shaped puff profile. This is repeated until the cigarette falls below a length defined in the standard. The smoke exiting from the mouth end of the cigarette is collected in a Cambridge Filter Pad, which is analyzed afterwards to determine the amount of tar and nicotine and, if needed, the content of various other substances. The gaseous components which are not absorbed in the filter are passed on and are also analyzed, for example to determine the content of CO.

The tobacco rod of a cigarette is wrapped with a cigarette paper, which at least partially consists of cellulose fibers, for example wood pulp fibers or fibers from flax, hemp or sisal.

The wood pulp fibers used for paper production are usually differentiated into long and short fibers, wherein the long fibers are typically cellulose fibers from coniferous wood, such as spruce or pine, with a length of more than 2 mm, while the short fibers originate generally from deciduous trees, such as birch, beech or eucalyptus, and typically have a length of less than 2 mm, often of about 1 mm.

The cellulose fibers typically account for about 60 to 100% by weight of the finished paper. The cigarette paper can also contain filler materials, wherein mainly chalk is used, but also other inorganic fillers are possible filler materials, such as titanium dioxide, calcium sulfate, magnesium carbonate, magnesium oxide, magnesium hydroxide, aluminum hydroxide and talc. The mass share of the inorganic fillers amounts typically to up to 40% by weight of the finished paper.

In addition the cigarette paper can contain substances which control the smoldering behavior of a cigarette. Examples are sodium and potassium citrates, sodium and potassium hydrogen carbonates, ammonium, sodium, and potassium acetates, and sodium and potassium salts of formic acid, malic acid, lactic acid and ammonium, sodium and potassium phosphates, which are added at a mass share of up to 5% by weight. Furthermore, the addition of aromatic substances is possible in order to adjust the taste of a cigarette manufactured from this cigarette paper or to aromatize the side-stream smoke.

An important parameter of a cigarette paper is its diffusivity. The diffusivity is a measure for the gas flow through the cigarette paper caused by a concentration difference. It therefore indicates the gas volume passing through the paper per unit of time, per unit of area and per concentration difference and thus has the unit $cm^3/(cm^2\ s)=cm/s$. A measurement of the $CO_2$ diffusivity can be carried out, for example, with a diffusion measurement instrument of the companies Borgwaldt KC (diffusivity tester) or Sodim ($CO_2$ diffusivity meter).

The measurement of diffusivity can take place under standard conditions according to ISO 187. Additionally, the cigarette paper can also be exposed to an elevated temperature to simulate a thermal stress. A possible approach is to expose the cigarette paper for 30 minutes to a temperature of 230° C. in the presence of air. This can be done in a common drying oven. Since the change in diffusivity of the cigarette paper due to the heating process is irreversible, the cigarette paper can be conditioned to the standard conditions according to ISO 187 after heating, before the measurement of diffusivity is performed. In the present disclosure all data on diffusivity are values which were obtained in accordance with this procedure, that is to say, after heating to 230° C. for 30 minutes and subsequent conditioning in accordance with ISO 187.

To reduce the amount of substances harmful to health in the smoke of a cigarette, several approaches are known from the prior art. One possibility is to dilute the smoke flowing through the cigarette by allowing an inflow of air. This is called ventilation. Increased ventilation leads to a stronger dilution of the main-stream smoke and consequently to lower smoke yields. The ventilation of a cigarette can be adjusted, for example, by a perforation on the tipping paper or by the air permeability of the cigarette paper.

A further option to adjust the smoke yields is the filtration of the main-stream smoke. This can be implemented, for example, by a filter made from cellulose acetate or by segmented filters. The latter, besides one or more segments made of cellulose acetate, also have chambers, which are filled with certain substances, for example activated carbon or paper filters. These cause additional filtration of the smoke and thus lead to a reduction of smoke yields, and sometimes also to a selective reduction of certain smoke components.

A further option to reduce the smoke yields consists in replacing some of the tobacco by a different material, which can be non-combustible in part, and therefore fewer harmful substances are generated on the whole. Such a material is described in K G. McAdam et al, *The use of a novel tobacco substitute-sheet and smoke dilution to reduce toxicant yields in cigarette smoke, Food and Chemical Toxicology*, Volume 49, Issue 8, 1684-1696 (2011). This is a material which consists largely of glycerin and sodium alginate.

On the whole, it is sought to achieve a reduction of smoke yields, preferably even a selective reduction of certain smoke components, but without causing a substantial change in the overall characteristic of the cigarette from the smoker's viewpoint. In particular, measures that negatively influence the customer acceptance or the taste of the cigarette, as is the case for example with high ventilation or strong filtration, are undesirable. Also, the replacement of tobacco by alternative materials has disadvantages. On the one hand such substitute materials can often be processed only poorly on conventional cigarette machines. On the other hand substances which are typically not present or are not present in the same ratio in tobacco or the cigarette paper are often included in the tobacco rod as a result of these substitute materials, which negatively influences the taste of such cigarettes.

SUMMARY

It is the object of the invention to provide means with which the harmful smoke yields of a smoking article can be reduced, while simultaneously minimizing the influence on taste for the smoker.

This object is achieved by a paper according to claim 1, a smoking article according to claim 21 and the use of the paper according to the invention according to claim 25. Further advantageous embodiments are specified in the dependent claims.

The paper according to the invention is intended for mixing into the smokeable material of a smoking article, for example into the tobacco rod of a cigarette. It contains a share of fibers, which contains cellulose fibers and tobacco particles. Here, the tobacco particles can form 2 to 20% by weight, preferably 5 to 15% by weight, and particularly preferably 5 to 10% by weight of the fiber share.

The inventor has found that the smoke yields can be reduced to a substantial extent if such paper containing tobacco particles is mixed with the actual tobacco, that is to say if this paper replaces some of the tobacco usually present. Simultaneously, the taste of the cigarette for the smoker is only influenced to a small extent by the addition of such paper. In this way a very advantageous compromise is made between reduction of smoke yields on the one hand and retention of the character of the cigarette, particularly of its taste, on the other hand.

As will be shown below by means of a series of exemplary embodiments, the smoke yields can be reduced to a much greater extent than a person skilled in the art might have expected by mixing the paper according to the invention into the tobacco rod. It is clear, that the smoke yields are reduced to the same extent as the tobacco is replaced by other, particularly non-combustible, paper components. The reduction of smoke yields, however, extends substantially beyond this foreseeable effect. Instead, an additional filtration effect can be produced with the paper according to the invention, which contributes to the reduction of smoke yields. However, the filtration effect alone cannot yet fully explain the observed reduction of smoke yields, since the person skilled in the art might have expected the smoke condensate deposited on the paper according to the invention to be released again to the same extent with the subsequent combustion of the paper during smoking, such that the concerned components would be smoked at best with a time delay. The measurement of the inventor has shown, however, that this is not the case. Instead, the inventor supposes that the filtration effect of the paper according to the invention is so strong that the smoke condensate is predominantly deposited in the area neighboring the smoldering cone, and the smoke condensate is then released into the side-stream smoke during the smoldering phase following a puff, in which some of the paper according to the invention together with the deposited smoke condensate is burnt, such that it is not contained in the main-stream smoke taken in by the smoker during a puff According to the invention, the tobacco particles have a mean size of less than 1 mm. Preferably, however, a mean size from 0.05 μm to 200 μm. The "size" of a tobacco particle refers here to the size of the tobacco particle determined with a sedigraph. These tobacco particles can be a waste product of tobacco processing, for example tobacco dust. However, it is also possible to use cut tobacco, which has been size-reduced by appropriate processes.

The paper according to the invention corresponds preferably substantially in terms of its structure to a conventional cigarette paper and, similarly thereto, contains pulp fibers, such as wood pulp fibers or pulp fibers from other plants, such as flax, hemp or sisal. According to the invention, the pulp fibers comprise a mixture of long and short fibers. In the present disclosure "long fibers" are fibers with a length of more than 2 mm and "short fibers" are fibers with a length of less than 2 mm, typically of about 1 mm. Basically, long fibers lead to an increase in tensile strength, while a higher share of short fibers provides the paper with a fluffy, porous structure. In terms of their function and properties in the fiber network, the tobacco particles are more suitable for replacing short fibers than long fibers.

The share of long and short fibers in the paper according to the invention can vary over wide ranges. According to the invention, the share of long fibers is more than 60% by weight, preferably, however, more than 80% by weight and particularly preferably more than 90% by weight of the fiber share of the paper. Preferably, the share of short fibers is less than 20% by weight, particularly preferably less than 10% by weight of the fiber share of the paper. It is, however, also possible, to use short fibers only. In this case however, because of the low strength, the short fibers should be refined in a manner known from the prior art.

As mentioned at the outset, the inventor supposed that the reduction of the smoke yields is essentially connected to the filtration property of the paper according to the invention. The filtration effect is influenced by the specific pore structure of the paper according to the invention, which can be characterized by the diffusivity. According to the invention, the paper is created such that, after heating to 230° C. for 30 min, it has a diffusivity from 0.01 cm/s to 2.0 cm/s, preferably, however, from 0.015 cm/s to 1.0 cm/s and particularly preferably from 0.16 cm/s to 0.75 cm/s, measured under the standard conditions according to ISO 187. The thermal exposure, performed before measurement, is intended to simulate the thermal stress in the tobacco rod during smoldering or smoking. In this way the diffusivity of the paper under conditions relevant in practice can be determined, at least approximately.

In an advantageous embodiment the paper has a thickness from 20 μm to 100 μm, preferably from 40 μm to 90 μm. A preferred basis weight is 20 g/m2 to 80 g/m$^2$, preferably 30 g/m$^2$ to 70 g/m$^2$. Such thicknesses and basis weights have been found in experiments to be adequate for the purpose of the invention in order to reduce smoke yields. A further practical advantage is that the paper of this thickness can be produced easily on typical machines for the production of common cigarette paper, as is used for wrapping a tobacco rod, for example.

In an advantageous embodiment the paper contains a filler, which accounts for up to 50% by weight, preferably 10 to 40% by weight, particularly preferably 20 to 35% by weight of the paper. An adequate filler is, for example, chalk, particularly precipitated chalk, which has a higher chemical purity than chalk from geological sources. Apart from chalk, however, other inorganic fillers can also be used, for example titanium dioxide, calcium sulfate, magnesium carbonate, magnesium oxide, magnesium hydroxide, aluminum hydroxide or talc, which can be used individually or in mixtures. A filler content of above 50% has been found to be less suitable because of the lower strength of the paper and the disposition of the paper to dust.

To control the smoldering speed of the paper according to the invention and thereby the puff number of a cigarette containing this paper, the paper according to the invention can be impregnated with burn additives. The burn additive can comprise one or more of the following materials: sodium citrate, potassium citrate, sodium hydrogen carbonate, potassium hydrogen carbonate, ammonium acetate, sodium acetate, potassium acetate, sodium or potassium salts of formic acid, malic acid or lactic acid, ammonium phosphate, sodium phosphate or potassium phosphate.

Preferably, the burn additive forms up to 5% by weight, particularly preferably up to 3% by weight of the total paper mass. The burn additives can be applied to the paper either directly in the paper machine by means of a size press or film press or afterwards in a separate apparatus.

Since the paper according to the invention is to replace some of the tobacco in the tobacco rod of the cigarette, its optical appearance also plays a role. Hence, additional colorants can be added to the paper according to the invention to adapt the color of the paper to that of the tobacco. One possibility is constituted by iron oxide particles, but other inorganic or organic colorants or pigments can also be used. Preferably, use will be limited to a share of up to 10% by weight of the paper mass because of a possible influence on the taste of a manufactured cigarette containing this paper.

To optimize the taste impression of the paper according to the invention during smoking, an aqueous tobacco extract can be applied to the paper. This extract can be produced by mixing the tobacco with a suitable quantity of water and filtering the mixture after storage, for example over 24 hours at room temperature or elevated temperature. The tobacco extract can be diluted or concentrated before it is applied to the cigarette paper. As with the burn additives, the application of this extract is possible in the size or film press or on a separate apparatus. Also, an application together with the burn additives is possible. After removal of the water the remaining solid content of the extract amounts to preferably up to 5% by weight of the paper mass, particularly preferably to 2 to 4% by weight. Additionally or alternatively, the paper can be treated with aromatic substances, which in this manner can be included easily in the smokeable material of the smoking article.

Alternatively or additionally to this extract, aromatic substances known from tobacco processing or humectants, such as glycerin or propylene glycol, can be applied to the paper according to the invention, wherein the sum of these substances is preferably up to 3% by weight of the paper mass, particularly preferably up to 2% by weight of the paper mass. Further additives as are common in the production of cigarette paper, for example starch, alginate, wet-strength agents, retention aids or other additives for paper production, can be contained in the paper, wherein the total share of these substances is preferably less than 2% by weight of the paper mass and particularly preferably less than 1% by weight.

The paper according to the invention can be produced on conventional paper machines, preferably Fourdrinier machines. Here, a fiber-filler suspension, which is applied to the wire of the paper machine from the head box, can be dewatered at first by vacuum and gravity, in the press section by mechanical pressure and finally in the drying section by heat, so that the paper can be rolled up at the end of the paper machine. The tobacco particles are treated here in the production process preferably in the same way as the short fibers in the production process of conventional cigarette papers and are hence preferably used unrefined.

To process the paper according to the invention on conventional cigarette machines in the same way as tobacco, it has to be cut into pieces of adequate size. The size of these pieces is derived from the cut size of tobacco, wherein the length can be from 0.1 mm to 10 mm, preferably 0.3 mm to 8 mm, particularly preferably 0 4 mm to 6 mm, and the width can be from 0.1 mm to 2 mm, preferably 0.3 mm to 1.5 mm, particularly preferably 0.4 mm to 1 mm.

The invention also concerns a smoking article, of which the smokeable material, particularly the tobacco rod, is mixed with paper according to one of the above-mentioned embodiments. Here, the paper according to the invention replaces some of the typically present smokeable material of the smoking article.

As will be shown in the exemplary embodiments below, the reduction of smoke yields is relatively severe, and therefore an appreciable effect may already be expected if just 2% of the mass of the smokeable material is replaced by the paper according to the invention. It is not recommendable to replace more than 50% of the mass of the smokeable material by the paper according to the invention, as in this case the taste of the cigarette will be too negatively influenced. Preferably, a range from 10 to 30% by weight of the mass of the smokeable material will be selected.

BRIEF DESCRIPTION OF THE DRAWINGS

FIG. 1 shows a table which summarizes the characteristic data of papers according to seven embodiments of the invention.

FIG. 2 shows a table which summarizes the smoke yields of tar, nicotine and carbon monoxide as well as the puff number of cigarettes, which result from the use of the seven papers according to the invention of FIG. 1 in a cigarette, as well as for the same cigarette without such a paper.

DETAILED DESCRIPTION

As a proof that the paper according to the invention achieves the desired effect, seven different papers filled with tobacco particles were produced. The detailed parameters of the produced papers can be seen in the table of FIG. 1. The papers differ mainly in the mixing ratio of long fibers, short fibers and tobacco particles, wherein the values in the table of FIG. 1 concerning long fibers, short fibers and tobacco particles refer to the mixing ratio among each other, that is to say in the "share of fibers", and not to their absolute content in the paper mass. The share of long fibers in examples 2-7 was between 80 and 95% by weight, the share of short fibers was up to 10% and the share of tobacco particles was between 5 and 10% by weight of the fiber share. In example 8 only short fibers and tobacco particles were selected as fibers.

Chalk was used as a filler, wherein, due to the purity, precipitated chalk was preferred, which is contained in the paper samples 2-6 in a share of 40% by weight of the paper mass. Paper sample 7 was produced entirely without chalk as inorganic filler. Additionally, the paper was impregnated with a tobacco solution. The production of such a tobacco solution was carried out by production of an aqueous suspension of tobacco particles, which was stored for 24 hours at room temperature and then filtered. The extract was applied to the paper in the size press. The paper samples 2, 4, 5 and 7 were additionally impregnated with potassium citrate, paper sample 5 was furthermore treated with an aromatic substance encapsulated in cyclodextrine from the company Mane.

Before mixing with the tobacco, the paper was shredded into pieces with a width from 0.4 mm to 1.0 mm and a length from 0.5 mm to 5.0 mm.

Cigarettes were manufactured using the paper samples 2-8. The cigarettes had a length of 84 mm, a diameter of about 8 mm and a filter plug made from cellulose acetate with a length of 16 mm, which was connected to the tobacco rod by a tipping paper with a length of 26 mm The cigarette paper, which wrapped the tobacco rod, had an air permeability of 32 CU (=$cm^3$/(min $cm^2$ kPa)), a basis weight of 25 g/$m^2$ and a chalk content of 26% by weight. The cigarette paper furthermore contained 2% by weight citrates as burn additive.

As tobacco, a commercial American Blend mixture of the brand BATTON was used. Each cigarette contained a total filling quantity of about 800 mg. This was composed of 80% by weight tobacco and 20% by weight of the paper according to the invention cut into pieces, such that each cigarette contained about 640 mg tobacco and about 160 mg of the paper according to the invention.

As a cigarette for comparison, a cigarette with the above technical data but with about 800 mg tobacco without the paper according to the invention was used.

The cigarettes were smoked according to ISO 4387, and puff number, tar, nicotine and carbon monoxide were determined The results can be found in the table of FIG. 2.

It can be seen that for all test cigarettes, which contain the paper according to the invention, a substantial reduction of smoke yields can be achieved. This reduction can be partially attributed to the fact that some of the tobacco was replaced by the non-combustible chalk, which is contained as filler in the test papers 2-6. However, in accordance with the content of chalk in the cigarette, this can explain a maximum reduction by 8%, and not, as was found in the experiments, by up to 70%. Additionally, also for test paper 7, which does not contain chalk, a substantial reduction of smoke yields can be seen. Finally, it can be seen that the reduction of smoke yields cannot be explained solely by a faster smoldering of the cigarette, as the puff number of all test cigarettes changes substantially less than would correspond to the reduction of the smoke yields. Test paper 8 was produced without the use of long fibers and also caused a substantial reduction of smoke yields, wherein for this paper the short fibers were refined to achieve a sufficient mechanical strength, while for the other test papers they were used unrefined. However, if emphasis is placed on a higher mechanical strength, a sufficient share of long fibers will preferably be selected.

Thus, a surprising reduction of smoke yields can be seen, which cannot be explained solely by consideration of the materials used in the papers according to the invention. Rather, apart from the sole replacement of tobacco by non-combustible material, an additional filter effect also seems to be present. The inventor supposes that the surprisingly clearly pronounced filter effect is caused by the special pore structure of the paper according to the invention and can be characterized by the diffusivity. For the test papers 2-7 there is a good correlation between the diffusivity and the reduction of smoke yields. For the data in FIG. 2 for example, the coefficient of correlation between the parameters "diffusivity" and "tar reduction" as well as the coefficient of correlation between the parameters "diffusivity" and "reduction of carbon monoxide" is greater than 0.9 in each case.

Indeed, the filtration effect of paper is known per se, but the person skilled in the art would have expected the smoke condensate deposited in the paper according to the invention to be released again to the same extent in the subsequent combustion of this paper during smoking, such that the concerned components are smoked only with a time delay. As the measured values in the table of FIG. 2 show, however, this is not the case. The inventor supposes that the filtration effect is so strong, that the smoke condensate is mainly deposited in the area lying next to the smoldering cone and that the smoke condensate is then released into the side-stream smoke during the smoldering phase following a puff, in which some of the paper according to the invention together with the deposited smoke condensate is burnt, such that it is not contained in the main-stream smoke taken up by the smoker during the subsequent puff The measurements show that the share of chalk in the paper samples has a significant influence on the reduction of smoke yields. This is based on the one hand on the fact that chalk is not combustible and thereby hardly contributes to the smoke yields, and on the other hand on the fact that it influences the diffusivity of the paper according to the invention. The values of 40% by weight of the paper mass in the samples 2-6 and of 0% of the paper mass in sample 7 show the extreme values. In many practical embodiments of the invention the chalk content will be in a middle range of this interval.

A further means to influence the diffusivity is the share of long fibers, short fibers and tobacco particles in the paper. As is visible from the test papers 2-7, a high content of unrefined short fibers and tobacco particles leads to a reduction of the diffusivity, for which reason these components can be effectively used to control the diffusivity and thereby also for the control of the reductive effect of the smoke yields. Paper sample 8 shows a substantially higher diffusivity, but this test paper is not comparable in all respects with the test papers 2-7 due to the refining of the short fibers.

The use of burn additives in the paper accelerates the smoldering of the cigarette and thereby reduces the puff number. For the paper samples 2, 4 and 5, which all contain about 2% by weight of potassium citrate as burn additive, a reduction of the puff number by about 10% could be achieved, which contributes to a reduction of the smoke yields approximately in the same ratio.

What is claimed is:

1. Paper for mixing into the smokeable material of a smoking article, wherein the paper contains a share of fibers which comprises pulp fibers and tobacco particles, wherein the tobacco particles have a mean size of less than 1 mm, wherein the pulp fibers comprise a mixture of long and short fibers in which the share of long fibers is more than 60% by weight of the fiber share of the paper, and wherein the paper has, after heating to 230° C. for 30 min, a diffusivity from 0.01 cm/s to 2.0 cm/s, measured under standard conditions according to ISO 187; and wherein the tobacco particles account for 2 to 20% by weight of the fiber share.

2. Paper according to claim 1, in which the tobacco particles account for 5 to 15% by weight of the fiber share.

3. Paper according to claim 2, in which the tobacco particles account for 5 to 10% by weight of the fiber share.

4. Paper according to claim 1, in which the tobacco particles have a mean size from 0.05 μm to 200 μm.

5. Paper according to claim 1, in which the share of long fibers is more than 80% by weight of the fiber share of the paper.

6. Paper according to claim 1, which, after heating to 230° C. for 30 min has a diffusivity from 0.015 cm/s to 1.0 cm/s measured under standard conditions according to ISO 187.

7. Paper according to claim 1, which, after heating to 230° C. for 30 min has a diffusivity from 0.16 cm/s to 0.75 cm/s, measured under standard conditions according to ISO 187.

8. Paper according to claim 1, wherein the paper has a thickness from 20 μm to 100 μm and the paper has a basis weight from 20 $g/m^2$ to 80 $g/m^2$.

9. Paper according to claim 8, wherein the paper has a thickness from 40 μm to 90 μm, and the paper has a basis weight from 30 $g/m^2$ to 70 $g/m^2$.

10. Paper according to claim 1, wherein the paper contains a filler, which accounts for up to 50% by weight of the paper, wherein the filler contains one or more of the following materials: chalk, particularly precipitated chalk, titanium dioxide, calcium sulfate, magnesium carbonate, magnesium oxide, magnesium hydroxide, aluminum hydroxide or talc.

11. Paper according to claim 1, which further contains a burn additive, which accounts for up to 5% by weight of the total paper mass, wherein the burn additive comprises one or more of the following materials: sodium citrate, potassium citrate, sodium hydrogen carbonate, potassium hydrogen carbonate, ammonium acetate, sodium acetate, potassium acetate, sodium or potassium salts of formic acid, malic acid or lactic acid, ammonium phosphate, sodium phosphate or potassium phosphate.

12. Paper according to claim 1, which further contains colorants or pigments, which account for up to 10% of the total paper mass.

13. The paper according to claim 12, wherein the colorants or pigments contain iron oxide.

14. Paper according to claim 1, which is impregnated with an aqueous tobacco extract, of which the solid content after removal of the water is up to 5% by weight of the paper.

15. The paper according to claim 14, which is treated with aromatic substances.

16. Paper according to claim 1, which is present in the form of pieces which have a length from 0.1 to 10.0 mm, and have a width from 0.1 to 2.0 mm.

17. Paper according to claim 16, which is present in the form of pieces which have a length from 0.3 to 8.0 mm, and have a width from 0.3 to 1.5 mm.

18. Paper according to claim 16, which is present in the form of pieces which have a length from 0.4 to 6.0 mm, and have a width 0.4 to 1.0 mm.

19. Paper according to claim 1, wherein the smokeable material is a tobacco rod of a cigarette.

20. Smoking article, of which the smokeable material is mixed with paper, wherein said paper contains a share of fibers which comprises pulp fibers and tobacco particles, wherein the tobacco particles have a mean size of less than 1 mm, wherein the pulp fibers comprise a mixture of long and short fibers, in which the share of long fibers is more than 60% by weight of the fiber share of the paper, and wherein the paper has, after heating to 230° C. for 30 min, a diffusivity from 0.01 cm/s to 2.0 cm/s, measured under standard conditions according to ISO 187; and wherein the paper has a share of the paper of 2 to 50% by weight of the mass of smokeable material.

21. Smoking article according to claim 20, which has a share of the paper of 10 to 30% by weight of the mass of smokeable material.

22. Smoking article of claim 20, which smoking article is a cigarette having a tobacco rod, wherein the tobacco of said tobacco rod is mixed with said paper.

23. Paper for mixing into the smokeable material of a smoking article, wherein said paper contains a share of fibers, which comprises pulp fibers and tobacco particles, wherein the tobacco particles have a mean size of less than 1 mm, wherein the pulp fibers comprise a mixture of long and short fibers, in which the share of long fibers is more than 60% by weight of the fiber share of the paper, and wherein the paper has, after heating to 230° C. for 30 min, a diffusivity from 0.01 cm/s to 2.0 cm/s, measured under standard conditions according to ISO 187; and wherein the paper has a thickness of 20 μm to 100 μm and the paper has a base weight from 20 $g/m^2$ to 80 $g/m^2$.

* * * * *